US009480335B2

(12) United States Patent
Ng

(10) Patent No.: US 9,480,335 B2
(45) Date of Patent: Nov. 1, 2016

(54) PANEL DISMOUNTING AND LOCKING MECHANISM OF DRAWER

(71) Applicant: GUANGDONG TAIMING METAL PRODUCTS CO. LTD, Foshan, Guangdong (CN)

(72) Inventor: Tai Wai Ng, Foshan (CN)

(73) Assignee: GUANGDONG TAIMING METAL PRODUCTS CO. LTD., Foshan (CN)

( * ) Notice: Subject to any disclaimer, the term of this patent is extended or adjusted under 35 U.S.C. 154(b) by 48 days.

(21) Appl. No.: 14/190,499

(22) Filed: Feb. 26, 2014

(65) Prior Publication Data

US 2015/0115788 A1 Apr. 30, 2015

(30) Foreign Application Priority Data

Oct. 31, 2013 (CN) ..... 2013 1 0530363

(51) Int. Cl.
*A47B 88/00* (2006.01)

(52) U.S. Cl.
CPC ..... *A47B 88/0051* (2013.01); *A47B 88/0055* (2013.01); *A47B 2088/007* (2013.01); *A47B 2088/0059* (2013.01)

(58) Field of Classification Search
CPC ..... A47B 88/0044; A47B 88/0051; A47B 88/0055; A47B 2210/02; A47B 2088/0059; A47B 2088/007; A47B 2088/0074; A47B 2088/0433; A47B 2088/0492
See application file for complete search history.

(56) References Cited

U.S. PATENT DOCUMENTS

| | | | | |
|---|---|---|---|---|
| 5,664,857 | A * | 9/1997 | Lautenschlager .. | A47B 88/0051 312/330.1 |
| 8,727,461 | B2 * | 5/2014 | Holzapfel ..... | A47B 88/0055 312/265.5 |
| 9,028,019 | B2 * | 5/2015 | Holzapfel ..... | A47B 88/0051 312/348.4 |
| 9,033,436 | B2 * | 5/2015 | Holzapfel ..... | A47B 88/0051 312/348.4 |
| 2010/0102692 | A1 * | 4/2010 | Hammerle ..... | A47B 88/0055 312/348.4 |
| 2014/0312756 | A1 * | 10/2014 | Ng ..... | A47B 88/0055 312/334.5 |

FOREIGN PATENT DOCUMENTS

| | | | | |
|---|---|---|---|---|
| AT | EP 0740917 | A1 * | 11/1996 | A47B 88/0051 |
| AT | WO 2009006651 | A2 * | 1/2009 | A47B 88/0055 |
| AT | WO 2012068599 | A1 * | 5/2012 | A47B 88/0055 |
| AT | WO 2012159139 | A1 * | 11/2012 | A47B 88/0051 |
| AT | WO 2012159140 | A1 * | 11/2012 | A47B 88/0051 |

* cited by examiner

*Primary Examiner* — Daniel J Troy
*Assistant Examiner* — Ryan A Doyle
(74) *Attorney, Agent, or Firm* — Maier & Maier, PLLC

(57) ABSTRACT

A panel dismounting and locking mechanism of a drawer comprises a side plate, a base plate and a sliding rail assembly for opening/closing the drawer, wherein a cavity of the side plate is internally provided with a dismounting and locking mechanism for locking and separating a front panel, which is rapidly dismounted from the dismounting and locking mechanism by a front jointer at least. The dismounting and locking mechanism at least comprises a main plate, a swing rod articulated with the main plate, and a sliding block located on the main plate through sliding of the swing rod. The main plate is provided with a guide slot, in which the front jointer can slide. The front panel is fastened with the sliding block by a location sidestep on the front jointer and is in contact with the sliding block by the end surface of the front jointer.

10 Claims, 5 Drawing Sheets

© 2014 Guangdong Taiming Metal Products Co. Ltd.

© 2014 Guangdong Taiming Metal Products Co. Ltd.

© 2014 Guangdong Taiming Metal Products Co. Ltd.

© 2014 Guangdong Taiming Metal Products Co. Ltd.

© 2014 Guangdong Taiming Metal Products Co. Ltd.

© 2014 Guangdong Taiming Metal Products Co. Ltd.

PANEL DISMOUNTING AND LOCKING MECHANISM OF DRAWER

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

RELATED APPLICATION INFORMATION

This patent claims the benefit of priority to Chinese Patent Application No. 201310530363.1, filed Oct. 31, 2013, of which full contents are incorporated herein by reference.

TECHNICAL FIELD

The present invention refers to a drawer, specifically a panel dismounting and locking mechanism of a drawer.

BACKGROUND ART

Chinese patent document number CN101224065A discloses a panel locking and regulating device of a drawer with a sliding rail on Jul. 23, 2008, comprising the sliding rail which is connected with the drawer; a panel of the drawer is connected with a regulating seat by a connecting piece, the regulating seat is internally provided with a guide slot, in which the connecting piece can slide. The guide slot is internally provided with a panel locking mechanism which includes an offset cam, one end of which is articulated on the regulating seat and the other end is articulated with a guide block by a connecting rod; one end of a swing rod is articulated on the guide block by a pin roll; a torsion spring is sheathed on the pin roll, and one end of the torsion spring leans against the swing rod and the other end leans against the guide block or the regulating seat; a sliding bush of the guide block is positioned in the regulating seat and the end part of the connecting piece is connected with the other end of the swing rod. The sliding bush of the guide block is positioned in a location bracket, and the rear part of the guide block is connected with one end of a first spring and the other end of the first spring leans against the location bracket. When the drawer in the structure is high relatively, the panel of the drawer is easy to be waggled to make the customer not very satisfied; furthermore, to fix the panel, the connecting piece on the panel needs to be simultaneously connected with the adjusting base; in this way, the load capacity of the drawer is increased, and if damaged, the whole device must be disassembled and replaced, which causes high maintenance cost, complexity in the disassembly and assembly procedures and inconvenience for users. Therefore, further improvement is necessary.

SUMMARY OF THE INVENTION

The invention is aimed at providing a panel dismounting and locking mechanism of a drawer, which is featured with simple design, reasonable structure, reliable performance, high connection stability, low manufacturing and maintenance costs, fast and convenient dismounting, easy adjustment, accurate location and high flexibility, so as to overcome the shortages in the prior art.

A panel dismounting and locking mechanism of a drawer, designed according to the purpose, comprises a side plate, a base plate and a sliding rail assembly for opening/closing the drawer, wherein a cavity of the side plate is internally provided with a dismounting and locking mechanism for locking and separating a front panel, which is rapidly dismounted from the dismounting and locking mechanism by a front jointer at least. The dismounting and locking mechanism at least comprises a main plate, a swing rod articulated with the main plate, and a sliding block located on the main plate through sliding of the swing rod. The main plate is provided with a guide slot, in which the groove on the front jointer can slide. The front panel is in contact with the baffle plate on the sliding block by the end surface of the front jointer, so that the fastener on the sliding block is fastened with a location sidestep on the front jointer to realize locking of the front panel; the front panel pushes out the sliding block through the swinging of the swing rod and is in contact with the end surface of the front jointer by the baffle plate on the sliding block to realize separation of the front panel. The main plate is provided with a torsion spring generating action force in the swinging process of the swing rod at least.

The dismounting and locking mechanism is also provided with upper/lower and left/right adjusting assemblies for adjusting upper/lower and left/right positions of the front panel.

One end of the swing rod is articulated with the main plate by a first connecting rivet, the middle part of the swing rod is in rotational connection with one end of the sliding block, and the other end of the sliding block is provided with an inclined sliding chute and located on the main plate by a fastener; and the sliding block slides on the main plate along the track of the inclined sliding chute in the swinging process of the swing rod at least.

The front jointer is L-shaped or T-shaped, on which a location sidestep is located, and the sliding block is provided with a clamp buckle and is fastened with the location sidestep in the locking and assembling process of the front panel at least.

The sliding block is provided with a baffle plate and is in contact connection with the end surface of the front jointer in the unlocking and dismounting process of the front panel at least.

At least one circular arc surface of inclined surface is located on the interconnection position of the front jointer and the sliding block, and the swing rod is provided with an unlocking action part for unlocking by inserting a tool at least.

The tension spring is located on the main plate by a second connecting rivet, including a supporting leg, one end of which is connected with the main plate and the other end is connected with the swing rod.

The main plate is provided with an elastic plate, which is located on the lower part of the swing rod and is in location fit with the swing rod in the locking and assembling process of the front panel; and the main plate is also provided with an upper cover, an elastic plate, a tension spring, a front jointer, a swing rod and a sliding block located between the main plate and the upper cover.

The upper/lower adjusting assembly comprises a fixed mount, an eccentric rivet and a rivet washer; the main plate is provided with a first adjusting hole for the eccentric rivet, the eccentric rivet is in rotational connection with the fixed mount by making the eccentric shaft thereon pass through the first adjusting hole and is located by the rivet washer; the tool acts on the action part of the eccentric rivet to drive the fixed mount to slide up and down to realize the purpose of adjusting the upper and lower positions of the front panel.

The left/right adjusting assembly comprises an adjusting screw, the upper cover is provided with a second adjusting hole corresponding to the adjusting screw, the adjusting screw, located on the front jointer, acts on the second adjusting hole by the rotating shaft thereon, and the tool acts on the action part of the adjusting screw to drive the front jointer to move left and right on the main plate, so as to realize the purpose of adjusting the left and right positions of the front panel.

Through the improvement of the above-mentioned structure in the invention, the cavity of the side plate is internally provided with a dismounting and locking mechanism for locking and separating a front panel under the premise of reducing and optimizing the product component; furthermore, upper/lower and left/right positions of the front panel can be adjusted step by step or steplessly by the dismounting and locking mechanism, so as to effectively simplify the structure of the structure, reduce the manufacturing cost and meet the customer requirements. The panel dismounting and locking mechanism of a drawer is featured with simple design, reasonable structure, reliable performance, high connection stability, low manufacturing and maintenance costs, fast and convenient dismounting, easy adjustment, accurate location and high flexibility, as well as high practicability.

ATTACHED DRAWINGS DESCRIPTION

SPECIFIC EMBODIMENT

Figure 1:
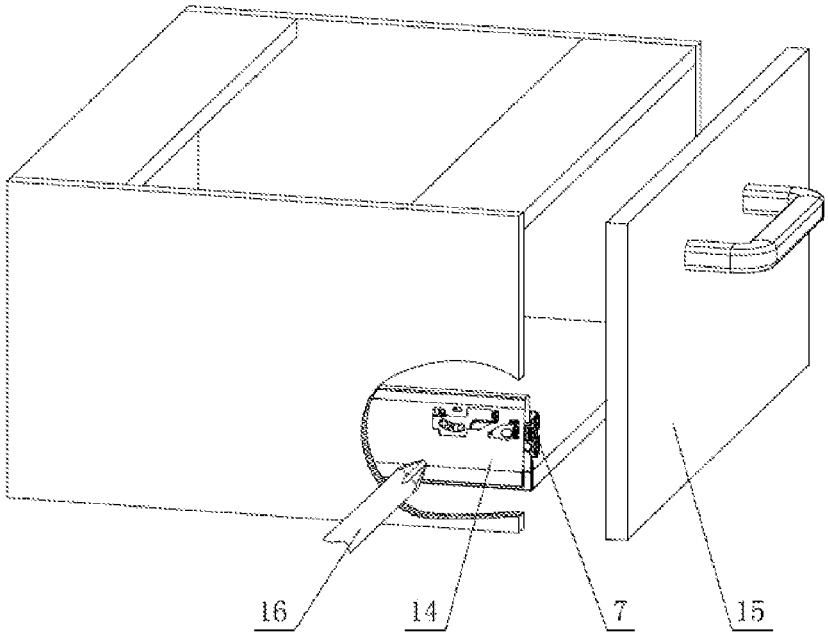
FIG. 1 shows a structure schematic diagram of an embodiment of the invention.
Figure 2:
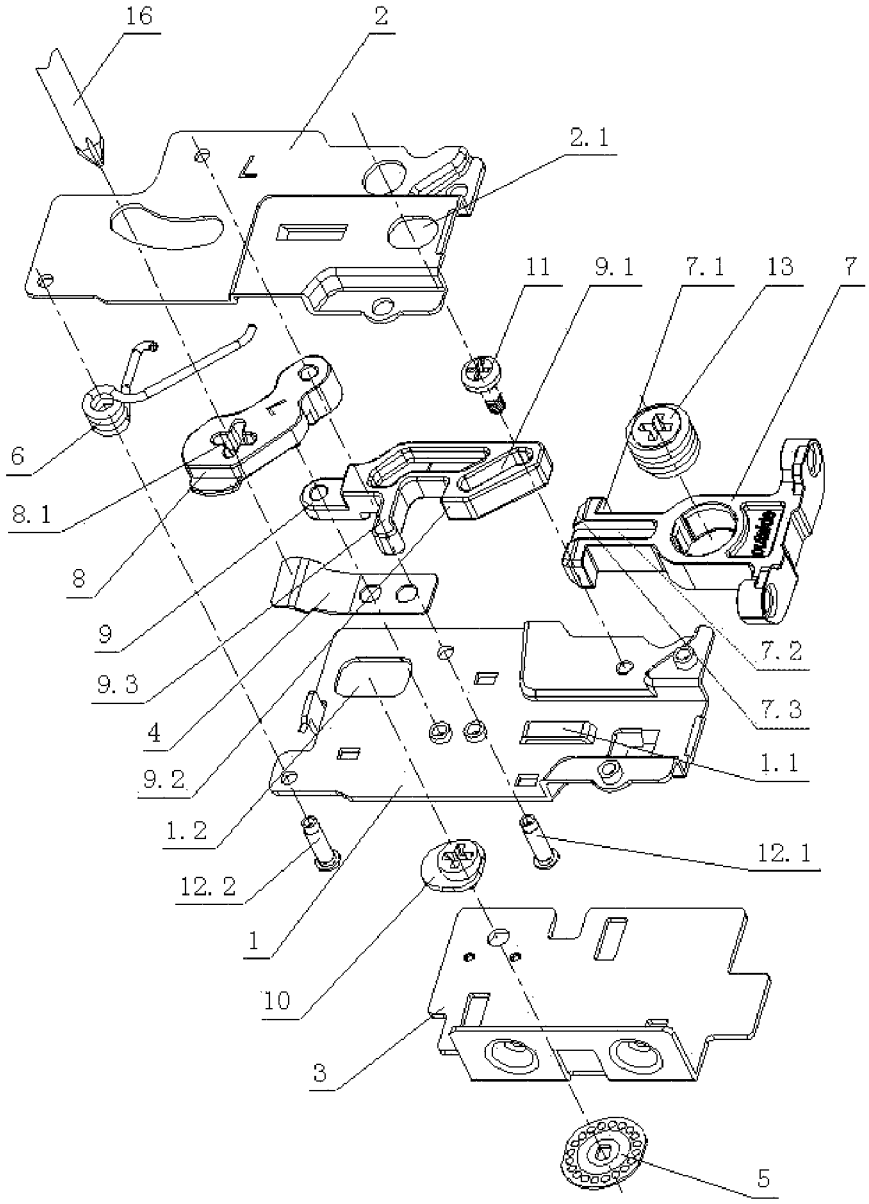
FIG. 2 shows a schematic diagram of breakdown structure for the dismountable and locking mechanism.
Figure 3:
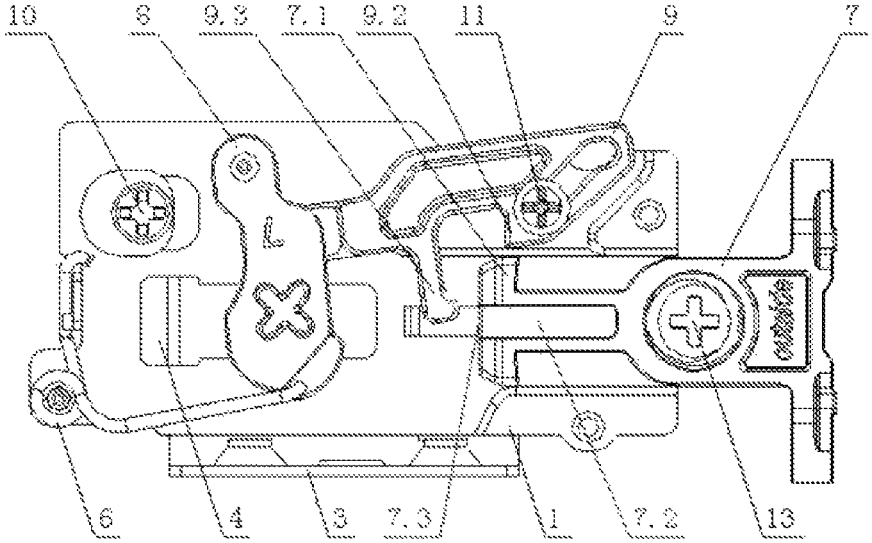
FIG. 3 shows a schematic diagram of separation structure for the front jointer and the dismounting and locking mechanism.
Figure 4:
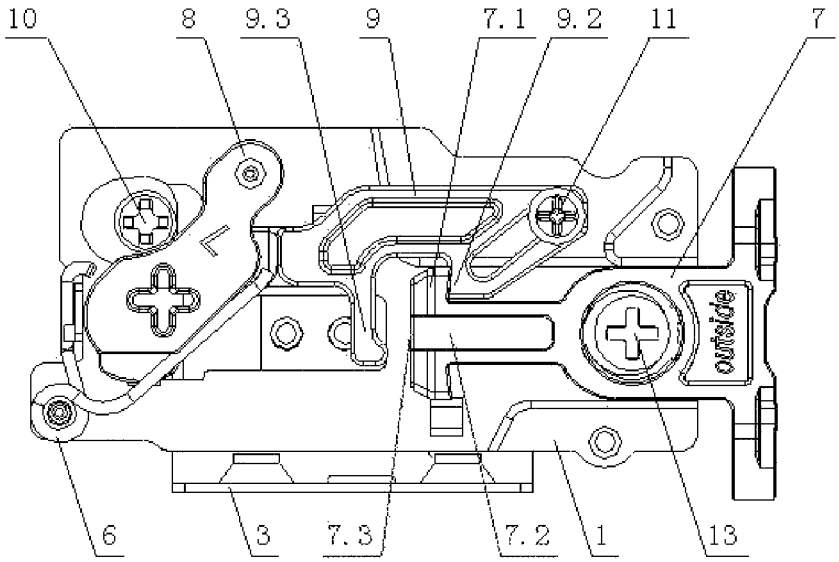
FIG. 4 shows a schematic diagram of locking structure for the front jointer and the dismounting and locking mechanism.
Figure 5:
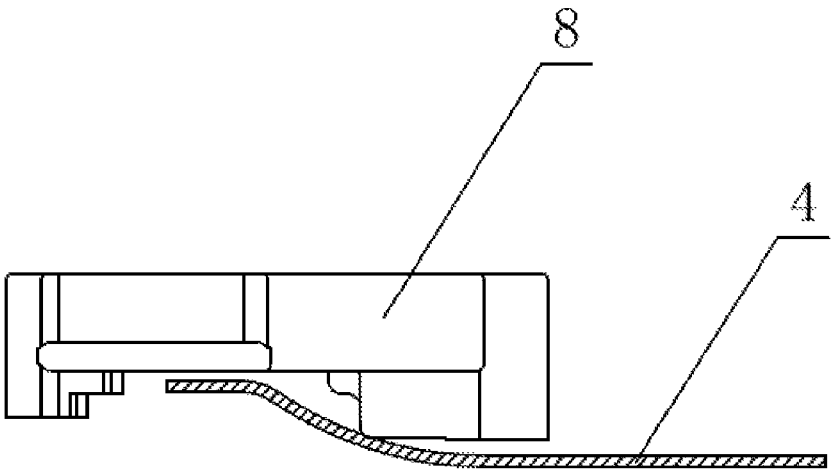
FIG. 5 shows a schematic diagram of connecting structure between the elastic plate and the swing rod.

The invention is further described by combining attached drawings and embodiments.

See FIG. 1 to FIG. 5. The panel dismounting and locking mechanism of a drawer comprises a side plate 14, a base plate and a sliding rail assembly for opening/closing the drawer, wherein a cavity of the side plate 14 is internally provided with a dismounting and locking mechanism for locking and separating a front panel 15, which is rapidly dismounted from the dismounting and locking mechanism by a front jointer 7 at least; the dismounting and locking mechanism at least comprises a main plate 1, a swing rod 8 articulated with the main plate 1, and a sliding block 9 located on the main plate 1 through sliding of the swing rod 8; the main plate 1 is provided with a guide slot 1.1, in which the groove 7.2 on the front jointer 7can slide, the front panel 15 is in contact with the baffle plate 9.3 on the sliding block 9 by the end surface 7.3 of the front jointer 7, so that the clamp buckle 9.2 on the sliding block 9 is fastened with a location sidestep 7.1 on the front jointer 7 to realize locking of the front panel 15; the front panel 15 pushes out the sliding block 9 through the swinging of the swing rod 8 and is in contact with the end surface 7.3 of the front jointer 7 by the baffle plate 9.3on the sliding block 9 to realize separation of the front panel 15; and the main plate 1 is provided with a tension spring 6 generating action force at least in the swinging process of the swing rod 8 and upper/lower and left/right adjusting assemblies for adjusting upper/lower and left/right positions of the front panel 15.

One end of the swing rod 8 is articulated with the main plate 1 by a first connecting rivet 12.1, the middle part of the swing rod is in rotational connection with one end of the sliding block 9, and the other end of the sliding block 9 is provided with an inclined sliding chute 9.1 and located on the main plate 1 by a fastener 11; and the sliding block 9 slides on the main plate 1 along the track of the inclined sliding chute 9.1 in the swinging process of the swing rod 8 at least, wherein the fastener 11 is in loose state when delivery. When the front panel 15 is high relatively, the fastener 11 is used for fixing by suggestion to prevent the front panel 15 from being loosened, but the fastener 11 needs to be loosened while dismounting the front panel 15 first, and then the swing rod 8 is rotated. Swinging angle of the swing rod 8 is 0 to 50 degrees.

The front jointer 7 is L-shaped or T-shaped, on which a location sidestep 7.1 is located, and the sliding block 9 is provided with a clamp buckle 9.2 and is fastened with the location sidestep 7.1 in the locking and assembling process of the front panel 15 at least. The sliding block 9 is provided with a baffle plate 9.3 and is in contact connection with the end surface 7.3 of the front jointer 7 in the unlocking and dismounting process of the front panel 15 at least. In order to connect the front jointer 7 with the sliding block 9 more reasonable, at least one circular arc surface of inclined surface is located on the interconnection position of the both, and the swing rod 8 is provided with an unlocking action part 8.1 for unlocking by inserting a tool 16 at least.

The tension spring 6 is located on the main plate 1 by a second connecting rivet 12.2, including a supporting leg, one end of which is connected with the main plate 1 and the other end is connected with the swing rod 8. The main plate 1 is provided with an elastic plate 4, which is located on the lower part of the swing rod 8 and is in location fit with the swing rod 8 in the locking and assembling process of the front panel 15; and the main plate 1 is also provided with an upper cover 2, an elastic plate 4, a tension spring 6, a front jointer 7, a swing rod 8 and a sliding block 9 located between the main plate 1 and the upper cover 2.

In the above-mentioned structure, the upper/lower adjusting assembly comprises a fixed mount 3, an eccentric rivet 10 and a rivet washer 5; the main plate 1 is provided with a first adjusting hole 1.2 for the eccentric rivet, the eccentric rivet 10 is in rotational connection with the fixed mount 3 by making the eccentric shaft thereon pass through the first adjusting hole 1.2 and is located by the rivet washer 5; the tool 16 acts on the action part of the eccentric rivet 10 to drive the fixed mount 3 to slide up and down to realize the purpose of adjusting the upper and lower positions of the front panel 15, wherein the scope of adjusting the upper and lower positions of the frontal panel 15 by the eccentric rivet 10 is +/−2 mm.

The left/right adjusting assembly comprises an adjusting screw 13, the upper cover 2 is provided with a second adjusting hole 2.1 corresponding to the adjusting screw 13, the adjusting screw 13, located on the front jointer 7, acts on the second adjusting hole 2.1 by the rotating shaft thereon, and the tool 16 acts on the action part of the adjusting screw 13 to drive the front jointer 7 to move left and right on the main plate 1, so as to realize the purpose of adjusting the left and right positions of the front panel 15, wherein the scope of adjusting the left and right positions of the frontal panel 15 by the adjusting screw 13 is +/−1.5 mm.

In order to cater to the usage requirements and different aesthetic habits of the consumers, the front panel 15 of the drawer can be made of wood, plastic, metal or glass according to the requirements, so that the drawer of the structure is featured with stronger market competitiveness and is more suitable for the customers to use.

Figure 6:
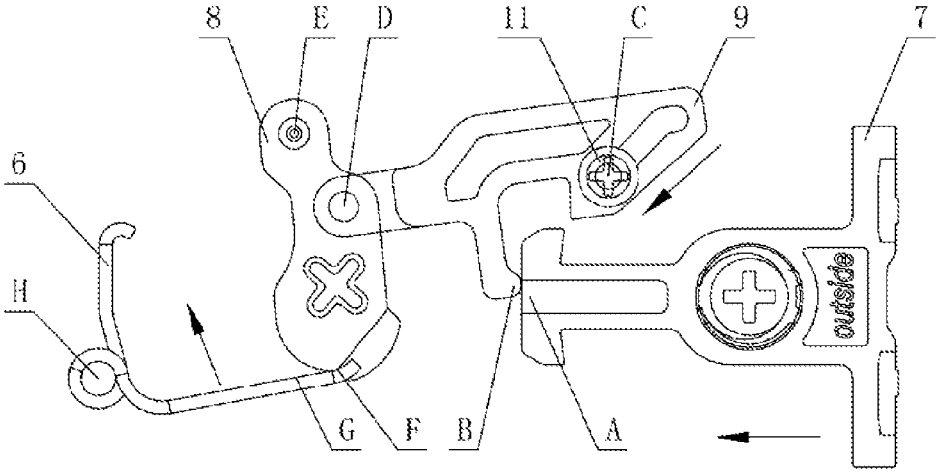
FIG. 6 to FIG. 8 show an operation schematic diagram of the invention.
Figure 7:
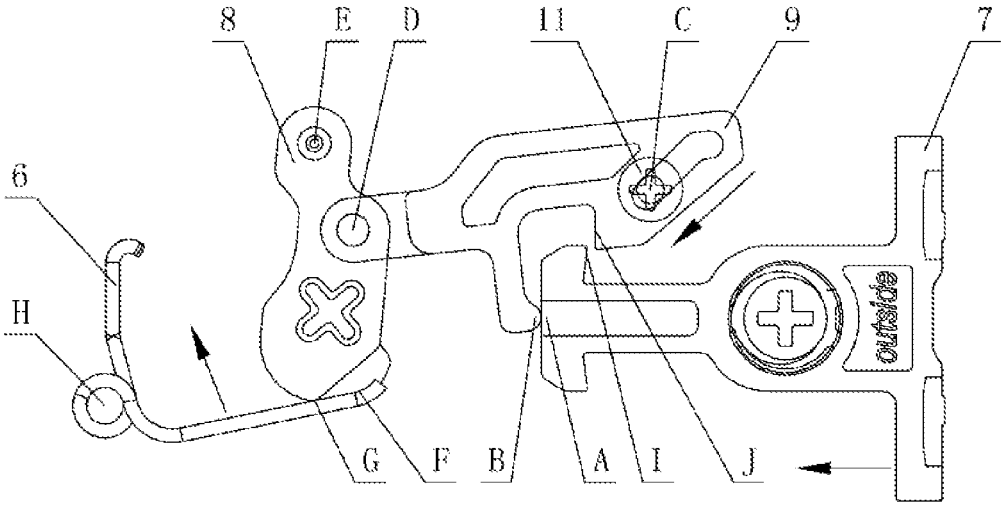
Figure 8:
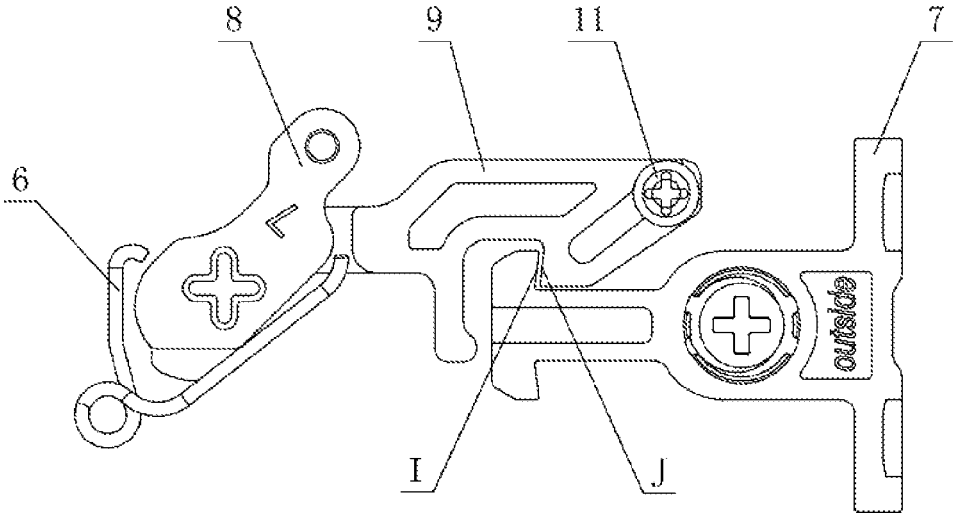

The working principle is shown in FIG. 6 to FIG. 8:

Installation: When the front jointer 7 enters into the main plate 1 of the dismounting and locking mechanism, the point A on the end surface of the front jointer 7 impacts the point B of the baffle plate 9.3 on the sliding block 9. When the front jointer 7 is moved forward continuously, the sliding block 9 slides along the point 11C of the fixed fastener through the track of the inclined sliding chute 9.1 thereon, and the sliding block 9 is used for pushing forward the swing rod 8 by the point D of the shaft connected with the swing rod 8. The swing rod 8 is swung in arc by taking the point E of the connecting rivet 12 as pivot; the swing rod 8 is in contact with one arm of the tension spring 6 to form the point F, and the swing rod 8 and one arm of the tension spring 6 form an included angle at this moment; the swing rod 8 continues to swing to arrive at the pint G, and at this time the tension spring 6 generates a powerful twisting force onto the swing rod 8, so that the swing rod 8 drives the sliding block 9 to move. In this way, the edge I on the front jointer 7 enters into the clamp buckle 9.2 of the sliding block 9, i.e. the edge I is in contact with the edge J. The tension spring 6 continues to generate the force to the swing rod 8. The sliding block 9 is tensioned sequentially under the action of the swing rod 8, so as to tension the front jointer 7, and therefore, the front panel 15 is locked. The location also can be realized by the elastic plate 4 in the arc swinging process of the swing rod 8, wherein the elastic plate 4 plays a role in anti-dropping to prevent the swing rod 8 from operating to the opposite direction.

Dismounting: The tool 16 is inserted into the unlocking action part 8.1 of the swing rod 8 to pass through the wall thickness of the swing rod 8. The top of the tool 16 leans against the elastic plate 4 and extrudes the same downwards, the tool 16 is rotated at this moment, and one arm of the tension spring 6 is tensioned by the swing rod 8. The sliding block 9 is moved forwards to slide along the track of the inclined sliding chute 9.1 by crossing the elastic plate 4. The point B of the baffle plate 9.3 on the sliding block 9 leans against the point A on the end surface of the front jointer 7, and the edge J of the sliding block 9 is also separated from the edge I of the clamp buckle 9.2 of the front jointer 7, so as to push out the front jointer 7 to realize the dismounting of the front panel 15.

The above is the optimized solution of the invention. Simple modification or transformation by common technical personnel is in the protection scope of the invention.

It is claimed:

1. A panel dismounting and locking mechanism of a drawer, comprising a side plate, a base plate and a sliding rail assembly for opening/closing the drawer, wherein a cavity of the side plate is internally provided with a dismounting and locking mechanism for locking and separating a front panel, which is rapidly dismounted from the dismounting and locking mechanism by a front jointer; the dismounting and locking mechanism including a main plate, a swing rod configured to articulate with the main plate, and a sliding block configured to slide on the main plate; the main plate is provided with a guide slot, in which a groove on the front jointer is configured to slide, the front panel configured to contact a baffle plate on the sliding block at an end surface of the front jointer, so that a fastener on the sliding block is fastened with a location sidestep on the front jointer to lock the front panel; the front panel configured to push out the sliding block through a swinging process of the swing rod, to realize separation of the front panel from the front joiner; and the main plate is provided with a tension spring configured to generate an action force during the swinging process of the swing rod, wherein one end of the swing rod is configured to articulate with the main plate by a first connecting rivet, a middle part of the swing rod is in rotational connection with one end of the sliding block, and the other end of the sliding block is provided with an inclined sliding chute and located on the main plate by a fastener; and the sliding block is configured to slide on the main plate along the track of the inclined sliding chute during the swinging process of the swing rod.

2. The panel dismounting and locking mechanism of a drawer of claim 1, wherein the dismounting and locking mechanism is provided with upper/lower and left/right adjusting assemblies for adjusting upper/lower and left/right positions of the front panel.

3. The panel dismounting and locking mechanism of a drawer of claim 2, wherein the tension spring is fastened to the main plate by a second connecting rivet, one end of the torsion spring is connected with the main plate and the other end is connected with the swing rod.

4. The panel dismounting and locking mechanism of a drawer of claim 1, wherein the front jointer is L-shaped or T-shaped, and the sliding block is provided with a clamp buckle configured to fasten with the location sidestep when the front panel is fastened to the front jointer.

5. The panel dismounting and locking mechanism of a drawer of claim 4, wherein the tension spring is fastened to the main plate by a second connecting rivet, one end of the torsion spring is connected with the main plate and the other end is connected with the swing rod.

6. The panel dismounting and locking mechanism of a drawer of claim 1, wherein the tension spring is fastened to the main plate by a second connecting rivet, one end of the torsion spring is connected with the main plate and the other end is connected with the swing rod.

7. The panel dismounting and locking mechanism of a drawer of claim 6, wherein the main plate is provided with an elastic plate, which is located on a lower part of the swing rod; and the main plate is also provided with an upper cover, wherein the elastic plate, the tension spring, the front jointer, the swing rod and the sliding block are each located between the main plate and the upper cover.

8. The panel dismounting and locking mechanism of a drawer of claim 7, further comprising an upper/lower adjusting assembly including a fixed mount, an eccentric rivet and a rivet washer; the main plate is provided with a first adjusting hole configured to receive the eccentric rivet, the eccentric rivet configured to be in rotational connection with the fixed mount; wherein a tool is configured to engage the eccentric rivet to slide the fixed mount to adjust one or more of an upper and lower position of the front panel.

9. The panel dismounting and locking mechanism of a drawer of claim 8, further comprising a left/right adjusting assembly including an adjusting screw on the front jointer, and a second adjusting hole on the upper cover corresponding to the adjusting screw, the adjusting screw configured to engage the second adjusting hole, and the tool if further configured to engage the adjusting screw to drive the front jointer to adjust one or more of a left and right position of the front panel.

10. The panel dismounting and locking mechanism of a drawer of claim 1, wherein the tension spring is fastened to the main plate by a second connecting rivet, one end of the torsion spring is connected with the main plate and the other end is connected with the swing rod.

* * * * *